US005516372A

United States Patent [19]

Riesop et al.

[11] Patent Number: 5,516,372

[45] Date of Patent: May 14, 1996

[54] PROCESS FOR PHOSPHATING STEEL STRIP GALVANIZED ON ONE SIDE

[75] Inventors: Joerg Riesop, Kerpen; Raschad Mady, Frechen; Dieter Geruhn, Werl; Frank Panter, Iserlohn; Franz Ricke, Schwelm; Hubertus Peters, Dortmund; Juergen Verheien, both of Dortmund; Manfred Wessel, Welver, all of Germany

[73] Assignees: Henkel Kommanditgesellschaft auf Aktien, Duesseldorf; Krupp Hoesch Stahl AG, Dortmund, both of Germany

[21] Appl. No.: 387,931

[22] PCT Filed: Aug. 18, 1993

[86] PCT No.: PCT/EP93/02205

§ 371 Date: Apr. 27, 1995

§ 102(e) Date: Apr. 27, 1995

[87] PCT Pub. No.: WO94/05826

PCT Pub. Date: Mar. 17, 1994

[30] Foreign Application Priority Data

Aug. 27, 1992 [DE] Germany ..... 42 28 470.8

[51] Int. Cl.[6] ..... C23C 22/12

[52] U.S. Cl. ..... 148/262

[58] Field of Search ..... 148/262

[56] References Cited

U.S. PATENT DOCUMENTS 4,793,867 12/1988 Charles et al. ..... 148/6.15

FOREIGN PATENT DOCUMENTS

| | | |
|---|---|---|
| 0219779 | 4/1987 | European Pat. Off. . |
| 0370535 | 5/1990 | European Pat. Off. . |
| 2038105 | 2/1972 | Germany . |
| 2043085 | 3/1972 | Germany . |
| 3245411 | 7/1984 | Germany . |
| 3630246 | 3/1988 | Germany . |
| 3932006 | 3/1990 | Germany . |
| 2-020879 | 1/1987 | Japan . |

OTHER PUBLICATIONS

Ullmann's Encyklopädie der technischen Chemie, 4th Edition, vol. 15, pp. 686 and 687.

"Überwachung von Phosphatierungsbädern (Monitoring of Phosphating Baths)", Galvanotechnik, 59 (1968), No. 1, pp. 37–39 (Eugen G. Leuze–Verlag, Saulgau).

*Primary Examiner*—Sam Silverberg
*Attorney, Agent, or Firm*—Ernest G. Szoke; Wayne C. Jaeschke; Daniel S. Ortiz

[57] ABSTRACT

A process for phosphating a galvanized surface of a steel strip electrolytically galvanized on one side by contacting the galvanized surface of the steel strip with a phosphating solution containing 1.0 to 6 g/l zinc, 0.5 to 5.0 g/l nickel and 14 to 25 g/l phosphate at a temperature of 40° to 70° C. for from 2 to 20 seconds. The ungalvanized surface remains metal bright.

33 Claims, No Drawings

PROCESS FOR PHOSPHATING STEEL STRIP GALVANIZED ON ONE SIDE

FIELD OF THE INVENTION

This invention relates to a process for phosphating steel strip electrolytically galvanized on one side to form nickel-containing zinc phosphate coatings on the galvanized surface. The zinc phosphate coatings are applied by brief spraying with or immersion in aqueous acidic phosphating solutions.

RELATED ART

Processes for phosphating surfaces of iron, steel, zinc and alloys thereof and also aluminium have long been known (Ullmann's Encyklopädie der technischen Chemie, 4th Edition, Vol. 15, pages 686 and 687). The object of phosphating the surfaces in question is to increase the adhesion of paint coatings and to improve protection against corrosion.

DE-A-32 45 411 describes a process for phosphating electrolytically galvanized metal articles, more particularly electrolytically galvanized steel strip, by brief treatment with acidic phosphating solutions which, besides zinc and phosphate ions, may contain other metal cations and/or anions of oxygen-containing acids with an accelerating effect. Zinc phosphate coatings with a weight per unit area of less than 2 $gm^{-2}$ are formed in this process. The acidic phosphating solutions used have a content of $Zn^{2+}$ cations of around 1 to 2.5 g/l and a free acid content of 0.8 to 3 points, the acid ratio of total acid to free acid being kept in the range from 5 to 10. The treatment is said to last not much longer than 5 seconds. Nitrate-containing phosphating baths are preferably used, the ratio by weight of $Zn^{2+}$ to $NO_{3-}$ being in the range from 1:1 to 1:8 and the ratio by weight of $PO_4^{3-}$ to $NO_{3-}$ being in the range from 1:0.1 to 1:2.5.

EP-A-0 219 779 describes a process for phosphating electrolytically galvanized metal articles, preferably electrolytically galvanized steel articles, more particularly electrically galvanized steel strip, by brief treatment for not much longer than 5 seconds with acidic phosphating solutions which, besides zinc, manganese and phosphate ions, may contain other metal cations and/or anions of oxygen-containing acids with an accelerating effect. To produce coatings consisting predominantly of zinc phosphate with a weight per unit area of less than 2 $gm^{-2}$, the phosphating solutions used have a content of zinc cations ($Zn^{2+}$) of 0.1 to 0.8 g/l, a content of manganese cations ($Mn^{2+}$) of 0.5 to 2.0 g/l and a free acid content of 4 to 8 points for an acid ratio (total acid to free acid) of 2.5 to 5.

JP-A-62 020 879 describes a process for phosphating galvanized steel strip on one side. In this process, phosphating is carried out by spraying of the phosphating solution onto the underneath of the steel strip while compressed air is blown onto the upper surface of the steel strip.

Now, the problem addressed by the present invention was to produce zinc phosphate coatings by spray or dip application to steel strip electrolytically galvanized on one side in such a way that, even after phosphating, the steel side would still represent a metallically bright surface. According to the invention, this would be done in treatment times of 2 to 20 seconds without any deterioration in corrosion protection and of course in such a way that dense, compact phosphate coatings would be formed on the galvanized side in the treatment times mentioned and in such a way that satisfactory forming properties would be obtained.

A further problem addressed by the invention was to apply the phosphate coatings thinly with weights per unit area of 0.5 to 3.0 $gm^{-2}$ and, more particularly, in the range from 1.0 to 2.0 $gm^{-2}$ without at the same time having to sacrifice uniform coverage of the steel strip galvanized on one side with a finely crystalline, firmly adhering and compact zinc phosphate coating.

In the context of the invention, the expression "steel strip electrolytically galvanized on one side" is of course also intended to encompass generally known zinc alloys (for example ZNE-electrolytically applied zinc alloy containing 10 to 13% of Ni or ZFE-electrolytically applied, Fe-containing zinc alloy).

The problems stated above have been solved by a process for phosphating the galvanized surface of steel strip electrolytically galvanized on one side to form nickel-containing zinc phosphate coatings by brief spraying with or immersion in acidic phosphating solutions, the treatment time being 2 to 20 s, depending on the rate of travel of the strip, the phosphating process being carried out at temperatures of 40° to 70° C. and the phosphating solutions satisfying the following requirements:

content of $Zn^{2+}$ cations: 1.0 to 6.0 g/l, content of $Ni^{2+}$ cations: 0.5 to 5.0 g/l, content of $PO_4^{3-}$ anions: 14 to 25 g/l, "free acid" content: 3.5 to 0.0 points, "total acid" content: 22 to 40 points.

The parameters mentioned above and their determination are described in detail in Chr. Ries, "Überwachung von Phosphatierungsbädern (Monitoring of Phosphating Baths)", Galvanotechnik, 59 (1968), No. 1, pages 37–39 (Eugene. Leuze-Verlag, Saulgau). Accordingly, the free acid content in points is defined as the quantity of 0.1N NaOH in ml needed to titrate 10 ml of bath solution against dimethyl yellow, methyl orange or bromphenol blue. The total acid content in points is defined as the quantity of 0.1N NaOH in ml needed to produce the first pink coloration in the titration of 10 ml of bath solution using phenolphthalein as indicator.

Accordingly, the combination of all the parameters mentioned is crucial to the process according to the invention.

BRIEF SUMMARY OF THE INVENTION

It is known that zinc is quickly dissolved out from the galvanized strip by the acidic phosphating solutions. Under certain plant operating conditions, a relatively high zinc content is established in the phosphating bath through the usual introduction of $Zn^{2+}$ cations by the steel strip galvanized on one side. Due to the establishment of equilibrium, a content of $Zn^{2+}$ cations of 3.0 to 5.0 g/l is preferred for the purposes of the invention.

If the content of nickel cations is less than 0.5 g/l, adhesion between the substrate and the coating after cataphoresis is inadequate. On the other hand, a nickel content of more than 5.0 g/l does not produce any further improvements so far as subsequent coating is preferred. Accordingly, the content of nickel cations is preferably adjusted in such a way that a concentration of 1.0 to 3.0 g/l is maintained in the phosphating bath.

DETAILED DESCRIPTION OF THE INVENTION

If the content of phosphate anions in the solution is less than 14 g/l, a defective zinc phosphate coating is formed. On the other hand, a phosphate content of more than 25 g/l does not provide for any additional advantageous effects. Accordingly, the use of relatively large amounts of phosphate has economic disadvantages. Accordingly, it is preferred to use a phosphating solution containing 19 to 23 g/l of phosphate ions.

The simultaneous presence of nickel cations and other divalent cations can improve paint adhesion, depending on the paint systems used, and can increase the corrosion protection level of the system after painting. In a preferred embodiment of the invention, therefore, the phosphating solutions additionally contain at least one other divalent cation selected from manganese, cobalt, iron, calcium and magnesium. According to the invention, these additional divalent cations are preferably used in the following concentrations in the phosphating solutions: 0.2 to 3.0 g/l manganese, 0.5 to 4.0 g/l cobalt, 0.05 to 1.0 g/l iron and 0.5 to 5.0 g/l calcium or magnesium. Divalent manganese is preferably used as the additional cation.

According to the invention, a crucial criterion is the time required for the phosphating treatment. Whereas, in the automotive industry, times of >120 seconds are normally required for phosphating, the target time in the phosphating of steel strip galvanized on one side is always well below 1 minute. According to the present invention, therefore, the treatment time is between 2 and 20 seconds and preferably between 5 and 10 seconds.

The major advantage of the present invention is that it enables zinc phosphate coatings to be produced on steel strip galvanized on one side in such a way that the galvanized surface is light in appearance while the ungalvanized surface remains metallically bright.

Although the presence of fluoride anions is generally not necessary in the case of steel strip electrolytically galvanized on one side, it can be of advantage in the interests of uniform coating. Accordingly, another preferred embodiment of the present invention is characterized in that the phosphating solutions have a content of fluoride anions of 0.0 to 0.5 g/l and preferably 0.1 to 0.2 g/l.

Phosphating itself is carried out at moderately elevated temperatures of around 40° to 70° C. Temperatures in the range from 55° to 65° C. can be particularly suitable.

The preparation of the phosphating solutions for carrying out the process according to the invention is generally effected in the usual manner known per se to the expert. Thus, water-soluble salts of the cations mentioned, for example the nitrates or carbonates, or corresponding soluble oxides or hydroxides may be used as starting materials for the preparation of the phosphating solutions. In general, the cations mentioned are used in the form of their nitrates although the nitrate content of the phosphating solutions has no effect on the phosphating result. The phosphate anions are generally introduced into the phosphating solutions in the form of phosphoric acid. The total acid content is adjusted through the content of phosphate anions in the phosphating solutions. The free acid content is optionally adjusted by increasing the pH value, for example by addition of sodium hydroxide or sodium carbonate. The fluoride anions optionally used in the phosphating solutions are generally introduced in the form of sodium fluoride or complex fluorides, for example tetrafluoroborate or hexafluorosilicate.

Before the phosphating solution is applied, the surface electrolytically galvanized on one side must be completely wettable with water. This is generally the case in continuous strip plants. If the surface of the strip galvanized one side has been oiled for storage and corrosion prevention, the oil must be removed before phosphating by suitable, already known preparations and methods. Thereafter the water-wettable galvanized metal surface is best subjected to an activating pretreatment known per se before the phosphating solution is applied. Suitable pretreatment methods are described in particular in DE-A-20 38 105 and in DE-A-20 43 085. Accordingly, the metal surfaces to be subsequently phosphated are treated with solutions essentially containing titanium salts and sodium phosphate, optionally together with organic components, such as alkyl phosphonates or polycarboxylic acids for example, as activating agents. Soluble compounds of titanium, such as potassium titanium fluoride or titanyl sulfate, may advantageously be used as the titanium component. Disodium orthophosphate is generally used as the sodium phosphate.

As described in the prior art (for example in DE-A-32 45 411), it can also be of advantage for the process according to the invention or rather the zinc phosphate coatings produced by the process according to the invention to passivate the phosphate layers produced in a following process step. The passivating treatment may be carried out, for example, with solutions containing chromates and Cr(III) salts or with Cr-free solutions.

Zinc phosphate coatings with a weight per unit area of less than 2 $gm^{-2}$ are produced on the galvanized side by the process according to the invention. The zinc phosphate coatings have a compact, finely crystalline structure and provide the steel strip electrolytically galvanized on one side with a desirable, uniform light grey appearance, the non-galvanized side being left with a metallically bright surface. A steel strip phosphated in this way may be further processed even without subsequent painting. The thin phosphate coatings produced by the process according to the invention show favorable behavior in numerous forming processes. Even subsequently applied organic coatings show distinctly improved adhesion in relation to the prior art both during and after the forming processes.

EXAMPLES

Steel electrolytically galvanized on one side (2.5 to 7.5 μm Zn) was surface-treated by the usual sequence of process steps:

1. Cleaning and degreasing

Spray application of surfactant-containing alkaline cleaners (such as RIDOLINE® C 72) for 5 to 20 seconds at 50° to 60° C.

2. Rinsing
3. Activation

Spray application of preparations containing titanium salts (such as FIXODINE® 950) for 2 to 4 seconds at 20° to 40° C.

4. Phosphating

For composition, see Table 1.

5. Rinsing
6. After-passivation

Spray or dip application of chromium-containing after-passivating preparations (such as DEOXYLYTE® 41B) for 2 to 6 seconds at 20° to 50° C.

7. Squeezing

Surplus liquid is removed by squeezing rollers without compression of the layer.

8. Drying

The strip dries under its own heat after squeezing.

A phosphate coating with a weight per unit area of 0.9 to 1.5 $gm^{-2}$ was produced on the steel electrolytically galvanized on one side.

TABLE 1

| | Composition of phosphating baths | | | | |
|---|---|---|---|---|---|
| | Examples | | Comparison Examples | | |
| | 1 | 2 | 1 | 2 | 3 |
| Bath parameter | | | | | |
| FA[1)] (points) | 5.5 | 4.6 | 2.2 | 3.5 | 4.6 |
| TA[2)] (points) | 30 | 40 | 16 | 20 | 37 |
| $Zn^{2+}$ g/l | 4.2 | 4.2 | 2.4 | 3.0 | 1.0 |
| $Mn^{2+}$ g/l | 0.0 | 1.7 | 0.0 | 0.0 | 1.7 |
| $Ni^{2+}$ g/l | 2.6 | 1.3 | 2.1 | 2.4 | 1.6 |
| $PO_4^{3-}$ g/l | 16.2 | 18.4 | 8.5 | 10.1 | 16.7 |
| Temp. °C. | 63 | 55 | 60 | 60 | 63 |
| Time s | 5 | 6 | 6 | 6 | 5 |
| Weight of phosphate coating | | | | | |
| (Zn side) $gm^{-2}$ | 1.5 | 1.4 | 1.5 | 1.3 | 0.9 |
| Appearance of ungalvanized surface | Metall. bright | Metall. bright | Serious brown phosphate discoloration | Streaky phosphate coating | Light coating |

[1)]FA = free acid
[2)]TA = total acid

We claim:

1. A process for phosphating a galvanized surface of a steel strip electrolytically galvanized on one side to form a nickel-containing phosphate coating which comprises: contacting at least the galvanized side of the steel strip for from 2 to 20 seconds at a temperature of 40° C. to 70° C. with a phosphating solution, comprising a) $Zn^{2+}$ cations: 1.0 to 6.0 g/l, b) $Ni^{2+}$ cations: 0.5 to 5.0 g/l, c) $PO_4^{3-}$ anions: 14 to 25 g/l, "free acid" content: 3.5 to 8.0 points, "total acid" content: 22 to 40 points.

to form a nickel containing phosphate coating of from 0.5 to 2 $gm^{-2}$ whereby an ungalvanized surface of the steel strip remains metal bright.

2. The process as claimed in claim 1, wherein the treatment time is 5 to 10 seconds.

3. The process as claimed in claim 1 wherein the content of $Zn^{2+}$ cations is 3.0 to 5.0 g/l.

4. The process as claimed in claim 1 wherein the content of $Ni^{2+}$ cations is 1.0 to 3.0 g/l.

5. The process as claimed in claim 1 wherein the phosphating solution contains 19 to 23 g/l of phosphate anions.

6. The process as claimed in claim 1 wherein the phosphating solution additionally contains at least one divalent cation selected from the group consisting of manganese, cobalt, iron, calcium and magnesium.

7. The process as claimed in claim 1 wherein the phosphating solution comprises fluoride anions up to 0.5 g/l.

8. The process as claimed in claim 1 wherein the phosphating is carried out at a temperature of 55° to 65 ° C.

9. The process as claimed in claim 1 wherein the zinc phosphate coating has a weight per unit area of from 1.0 $gm^{-2}$ to 2 $gm^{-2}$.

10. The process as claimed in claim 1 wherein the steel strip, electrolytically galvanized on one side, has been subjected to an activating pretreatment.

11. The process of claim 2 wherein the content of $Zn^{2+}$ cations is from 3.0 to 5.0 g/l.

12. The process of claim 2 wherein the content of $Ni^{2+}$ cations is 1.0 to 3.0 g/l.

13. The process of claim 3 wherein the content of $Ni^{2+}$ cations is 1.0 to 3.0 g/l.

14. The process of claim 2 wherein the phosphating solution contains 19 to 23 g/l of phosphate anions.

15. The process of claim 3 wherein the phosphating solution contains 19 to 23 g/l of phosphate anions.

16. The process of claim 4 wherein the phosphating solution contains 19 to 23 g/l of phosphate anions.

17. The process of claim 1 wherein the phosphating solution further comprises at least one divalent cation selected from the group consisting of manganese, cobalt, iron, calcium and magnesium when, if present, is present in an amount of from 0.2 to 3.0 g/l manganese, 0.5 to 4.0 g/l cobalt, 0.05 to 1.0 g/l iron, and 0.5 to 5.0 g/l calcium, and 0.5 to 5.0 g/l magnesium.

18. The process of claim 2 wherein the phosphating solution additionally contains at least one divalent cation selected from the group consisting of manganese, cobalt, iron, calcium and magnesium.

19. The process of claim 2 wherein the phosphating solution further comprises at least one divalent cation selected from the group consisting of manganese, cobalt, iron, calcium and magnesium when, if present, is present in an amount of from 0.2 to 3.0 g/l manganese, 0.5 to 4.0 g/l cobalt, 0.05 to 1.0 g/l iron, and 0.5 to 5.0 g/l calcium, and 0.5 to 5.0 g/l magnesium.

20. The process of claim 3 wherein the phosphating solution additionally contains at least one divalent cation selected from the group consisting of manganese, cobalt, iron, calcium and magnesium.

21. The process of claim 3 wherein the phosphating solution further comprises at least one divalent cation selected from the group consisting of manganese, cobalt, iron, calcium and magnesium when, if present, is present in an amount of from 0.2 to 3.0 g/l manganese, 0.5 to 4.0 g/l cobalt, 0.05 to 1.0 g/l iron, and 0.5 to 5.0 g/l calcium, and 0.5 to 5.0 g/l magnesium.

22. The process of claim 4 wherein the phosphating solution additionally contains at least one divalent cation selected from the group consisting of manganese, cobalt, iron, calcium and magnesium.

23. The process of claim 4 wherein the phosphating solution further comprises at least one divalent cation selected from the group consisting of manganese, cobalt, iron, calcium and magnesium when, if present, is present in an amount of from 0.2 to 3.0 g/l manganese, 0.5 to 4.0 g/l cobalt, 0.05 to 1.0 g/l iron, and 0.5 to 5.0 g/l calcium, and 0.5 to 5.0 g/l magnesium.

24. The process of claim 5 wherein the phosphating solution additionally contains at least one divalent cation selected from the group consisting of manganese, cobalt, iron, calcium and magnesium.

25. The process of claim 5 wherein the phosphating solution further comprises at least one divalent cation selected from the group consisting of manganese, cobalt, iron, calcium and magnesium when, if present, is present in an amount of from 0.2 to 3.0 g/l manganese, 0.5 to 4.0 g/l cobalt, 0.05 to 1.0 g/l iron, and 0.5 to 5.0 g/l calcium, and 0.5 to 5.0 g/l magnesium.

26. The process of claim 2 wherein the phosphating solution comprises fluoride anions up to 0.5 g/l.

27. The process of claim 3 wherein the phosphating solution comprises fluoride anions up to 0.5 g/l.

28. The process of claim 4 wherein the phosphating solution comprises fluoride anions up to 0.5 g/l.

29. The process of claim 5 wherein the phosphating solution comprises fluoride anions up to 0.5 g/l.

30. The process of claim 6 wherein the phosphating solution comprises fluoride anions up to 0.5 g/l.

31. The process of claim 2 wherein the phosphating is carried out at a temperature of 55° to 65° C.

32. The process of claim 2 wherein the steel strip, electrolytically galvanized on one side, has been subjected to an activating pretreatment,

33. The process of claim 10 wherein the activating pretreatment comprises contacting at least the electrogalvanized surface with a titanium containing activating composition.

* * * * *